United States Patent [19]

Huebener

[11] 4,151,949

[45] May 1, 1979

[54] SIGNAL DEVICE

[76] Inventor: Paul E. Huebener, 5035 17th Ave. South, Minneapolis, Minn. 55417

[21] Appl. No.: 836,600

[22] Filed: Sep. 26, 1977

[51] Int. Cl.[2] ..... A47G 29/12

[52] U.S. Cl. ..... 232/34

[58] Field of Search ..... 232/34, 35

[56] References Cited

U.S. PATENT DOCUMENTS

| | | | |
|---|---|---|---|
| 879,022 | 2/1908 | Wolf | 232/34 |
| 1,346,789 | 7/1920 | Runkle | 232/34 |
| 1,499,771 | 7/1924 | Guy | 232/35 |
| 2,002,423 | 5/1935 | Wade | 232/34 |
| 2,834,539 | 5/1958 | Carey | 232/35 |
| 3,081,024 | 3/1963 | Sichler | 232/34 |
| 3,093,302 | 6/1963 | Alley | 232/35 |
| 3,144,986 | 8/1964 | Hendrickson | 232/35 |

*Primary Examiner*—Francis K. Zugel

*Attorney, Agent, or Firm*—Norman P. Friederichs

[57] ABSTRACT

A signal device is disclosed suitable for mounting upon a mailbox to indicate incoming or outgoing mail. The signal device includes a pocket and a pair of flags mounted on either end of a pivotal arm. The flags are adapted for alternate exposure or for concealment of both flags within the pocket.

1 Claim, 5 Drawing Figures

FIG. I
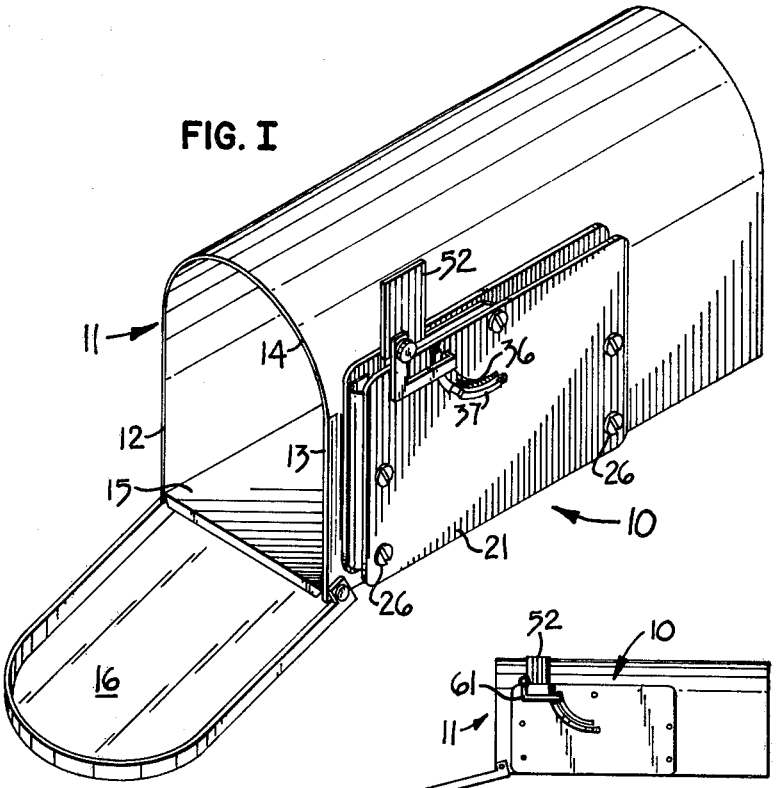
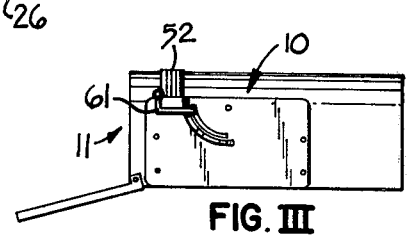
FIG. III
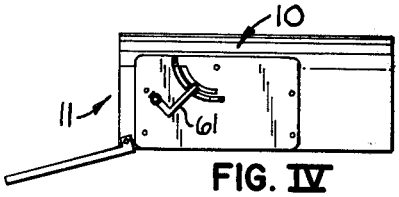
FIG. IV
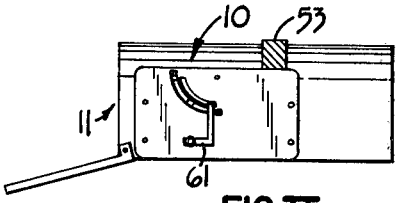
FIG. V
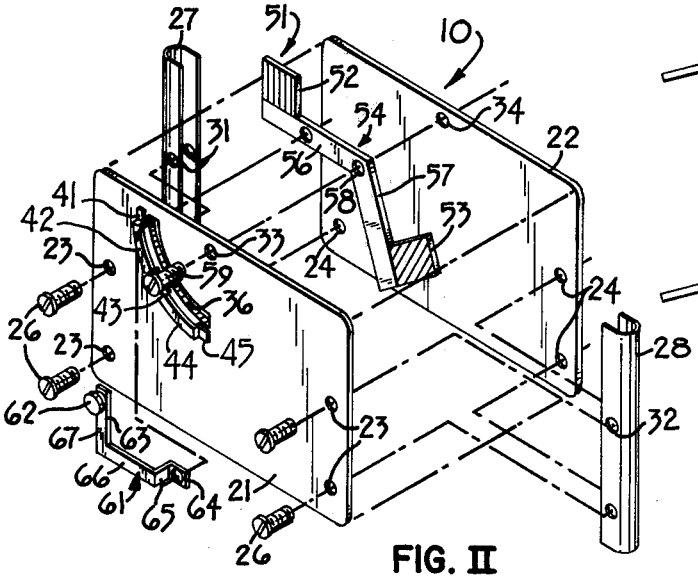
FIG. II

SIGNAL DEVICE

BACKGROUND OF THE INVENTION

The present invention relates to signal devices and more particularly to signal devices for indicating the presence of mail in a mailbox.

Signal devices for use in conjunction with rural type mailboxes have been long known. Conventionally rural mailboxes have been located a substantial distance from the residence being served and have required that the home resident walk from the house to the mailbox for deposit and pickup of the mail. Also, such mailboxes have been serviced by postal employees in automotive vehicles. It is time consuming for the postal employee to stop, open each box to determine if any outgoing mail is in the box for pickup and transporting to the post office. For this reason, many years ago, the postal service encouraged home owners to provide signal devices on the box which indicate to the postman if outgoing mail is present in the box. Such signal devices generally have included a red flag supported on a pivotal arm. This device has normally been visible at all times and only its relative position indicates whether or not outgoing mail is present in the box.

The resident has generally been at a disadvantage in that he can only ascertain if incoming mail is present in the box by walking to the remote mailbox, opening and examining the interior of the box. Some attempts have been made in the past, to provide a signal device which advises the resident of mail contained in the box. Such structures have generally been complicated in structure and operation and therefore have not been well accepted.

The present invention provides a signal device for use in conjunction with a mailbox suitable for indicating incoming as well as outgoing mail. The present invention is simple in construction as well as simple in operation. The signal device of the present invention is suitable for attachment to existing remote mailboxes as well as suitable for provision with newly manufactured mailboxes.

GENERAL DESCRIPTION OF THE PRESENT INVENTION

The present invention includes a packet and a pair of flags mounted on opposite ends of a pivotal arm. The pivot support of the arm is located intermediate the flags. The flags may be constructed of a rigid material such as metal or plastic and if desired, may be relatively light of weight. The flags may be integral with the opposite ends of the arm and are of readily distinguishable contrasting color. For example, one flag may be red in color and the other flag green or blue. The flags desirably are of a size sufficient to permit ready observance from a substantial distance and in particular, at a distance sufficient to enable the postal employee to stop to collect outgoing mail and for the home resident to observe deposited incoming mail without leaving the house. The term "outgoing mail" as used herein means mail that is leaving the home and coming into the postal system. The term "incoming mail" means mail that is leaving the postal system and coming to the home. Although the present signal device is disclosed in conjunction with a mailbox it is to be recognized that the device may have broader use application.

The signal device desirably includes a pocket within which the flags and supporting arm may be concealed and yet one in which either of the flags may be alternatively exposed. The signal device may further include a handle or a grip which is attached to the arm of one of the flags by which the signal device may be shifted from one position to another.

In the drawings:

FIG. I is a perspective view of the signal device of the present invention shown in conjunction with a conventional mailbox;

FIG. II is an exploded perspective view of the signal device;

FIG. III illustrates the signal device in a position indicating outgoing mail;

FIG. IV shows the signal device in a neutral position, and;

FIG. V shows the device in a position indicating incoming mail.

DETAIL DESCRIPTION OF THE PRESENT INVENTION

The signal device 10, one preferred embodiment of which is shown in FIGS. I–V may be used in conjunction with a conventional mailbox 11. Such conventional boxes 11 may include a pair of vertical sidewalls 12 and 13, a curvelinear top 14 and a floor 15. The box 11 may include a hinged door 16 and a rear wall (not shown). The signal device 10 may be secured to the sidewall 13 of box 11 as hereinafter described.

The signal device 10 as shown in FIG. II may include a front panel 21 and a rear panel 22. The panels 21 and 22 may be of any suitable rigid material such as sheet metal or sheet plastic. The panels 21 and 22 may include a plurality of openings such as 23, 24 respectively. The openings 23 are aligned with the corresponding openings 24 so that screws 26 may be inserted therethrough. The screws 26 may be threadedly engaged in the openings 24. Alternatively, threaded nut (not shown) may be secured to the portion of screws 26 which extend through rear panel 22.

The signal device 10 includes spacers 27, 28 which maintain an appropriate spacing between panels 21 and 22. Any of various types of spacers may be utilized. Spacers 27 and 28 are shown as strap members which are U-shaped in cross section. The spacers 27 and 28 have suitable openings 31, 32 respectively through which screws 26 may extend. Thus, screws 26 serve to hold panels 21 and 22 together with the spacers 27 and 28 held therebetween. Alternatively, cylindrical spacers may be disposed concentric with screws 26. Panel 21 further includes an opening 33 which is aligned with an opening 34 in panel 22 for purposes hereinafter described. Panel 21 has an arcuate slot 36 defined therein and a pair of stop members 37 adjacent slot 36. The stop member 37 may be formed of strap material substantially in the shape shown in FIG. 2. Stop member 37 for example, includes a first portion 41 which is immediately adjacent panel 21 and may be secured thereto such as by resistance welding. Stop member 37 has a second portion 42 spaced outwardly from panel 21, a portion 43 closely adjacent panel 21, an outwardly spaced portion 44 and a portion 45 which is secured to panel 21 such as by resistance welding.

Signal device 10 has a signal member 51 including a pair of flags 52, 53 of contrasting colors. For example, one flag may be red whereas the other is green. The flags 52, 53 are attached to or integral with an arm 54. The flags 52, 53 and arm 54 all may be cut from a single sheet of metal or plastic.

The arm 54, preferably includes portions 56, 57 which are at an angular relationship to one another for purposes hereinafter described. Arm 54 has an opening 58 therein which may be aligned with opening 33 in panel 21 and opening 34 in panel 22. A screw 59 may be inserted through openings 33, 58 and 34 to maintain flag member 51 in place. Friction collars (not shown) may be provided on either side of arm 34 and mounted on screw 59 in order to maintain flag 51 in the desired position of rotation about screw 59. A handle or grip 61 may be suitably attached to flag device 51 such as by a screw (not shown) or by friction welding. The handle 61 is shown including a knob 62 and a strap member 63. Strap member 63 may have a first portion 64 which is disposed immediately adjacent arm member 56 and secured thereto such as by a screw. Strap 63 includes a second portion 65 which extends outwardly from portion 64. When assembled, the portion 65 extends through and rides in slot 36. Member 61 further includes portions 66 and 67 which are integral with portion 65. The knob 62 may be attached to portion 67 in any desired manner.

OPERATION OF THE INVENTION

Although the operation of the present invention is apparent from the foregoing description, it will be further described hereinafter. The signal device 10 may be secured to a mailbox 11 by any suitable approach such as contact adhesive or bolts. Once the device 10 is in place, one may grasp the knob 62 of handle 60 and move the member 51 to the neutral position shown in FIG. IV with both flags concealed. Of course, during such movement, member 51 pivots on screw 59. If the resident deposits outgoing mail in box 11, the knob 62 is grasped and member 51 is moved to the position shown in FIG. III with the red flag exposed. When in such position arm 61 lies in the slot formed by portion 41 of stop 37 and is held in place by stop 37. When the postal employee observes the red flag, he stops and picks up the outgoing mail. If the postal employee is not leaving mail, he moves the signal device to the position of FIG. IV with arm 61 resting adjacent portion 43 of stop 37. If he is depositing incoming mail, he moves the device to the position shown in FIG. V and arm 61 is held at portion 45 of stop 37. When moving from one position to another arm 61 may slide along the outwardly spaced portions such as portions 42 and 44.

Various modifications may be made without departing from the broader scope of the present invention. For example, the arm 54 may be straight rather than angled. Also the flags 52 and 53 may extend downwardly rather than upwardly from arm 54.

What is claimed is:

1. A signal device for use in conjunction with a mailbox, said signal device including:

pocket means adapted for attachment to the mailbox, said pocket means comprising a pair of spaced plate members and detent stop means; and signal means mounted in said pocket means, said signal means including a pair of flag members and means for supporting said flag members with respect to each other and with respect to said pocket means, said support means comprising an arm including two integral arm portions, said arm portions being disposed at an angular relationship to each other, said flag members being of contrasting colors, said signal means being disposed in the space between said plate members, and said detent stop means serving to retain said arms in selected positions, one of said plate members including an arcuate slot, said signal means including lever means which extends through said slot for driving said arm, said flag members thereby being adapted for concealment of both members of said pair within said pocket and for alternate exposure of either of said flag members.

* * * * *